United States Patent [19]

Dodd et al.

[11] Patent Number: 4,996,464

[45] Date of Patent: Feb. 26, 1991

[54] IGNITOR DISABLER

[75] Inventors: Peter G. Dodd, Scarborough; Franklyn Harrison, Oakville, both of Canada

[73] Assignee: Cooper Industries, Inc., Houston, Tex.

[21] Appl. No.: 374,647

[22] Filed: Jun. 30, 1989

[30] Foreign Application Priority Data

May 26, 1989 [CA] Canada ..... 600879

[51] Int. Cl.[5] ..... H05B 41/14

[52] U.S. Cl. ..... 315/289; 315/290; 315/307

[58] Field of Search ..... 315/289, 290, 239, 205, 315/225

[56] References Cited

U.S. PATENT DOCUMENTS

| | | | |
|---|---|---|---|
| 3,774,074 | 11/1973 | Souvay | 315/239 |
| 4,179,641 | 12/1979 | Britton | 315/289 |
| 4,207,500 | 1/1980 | Duve et al. | 315/289 |
| 4,455,509 | 1/1984 | Crum et al. | 315/225 |
| 4,495,446 | 1/1985 | Brown et al. | 315/289 |
| 4,665,346 | 1/1987 | Tarroux | 315/290 |
| 4,763,044 | 8/1988 | Nuckolls et al. | 315/289 |
| 4,896,077 | 1/1990 | Dodd et al. | 315/289 |

*Primary Examiner*—Eugene R. LaRoche
*Assistant Examiner*—Son Dinh
*Attorney, Agent, or Firm*—Blake, Cassels & Graydon

[57] ABSTRACT

An ignitor disabler for the starter circuit of a High Intensity Discharge (HID) lamp includes means for disabling the ignitor, and means for triggering the disabling means of the ignitor after passage of a predetermined amount of time. The triggering means has a timing component that begins time measuring operation only under certain, predetermined conditions. The disabler includes means for resetting the timing component of the triggering means upon lamp ignition. In its preferred embodiment, the starter circuit specifically includes a power supply portion in use to convert alternating current to direct current and designed to provide a stable direct current output over a broad range of input signals.

11 Claims, 3 Drawing Sheets

IGNITOR DISABLER

BACKGROUND OF THE INVENTION

1. Field of the Invention

This invention relates to ignitor disablers for vapour discharge lamps, and more particularly, to ignitor disablers which are suitable for disabling ignitors employed in igniting and operating circuits for High Intensity Discharge (HID) lamps, particularly of the high pressure sodium type.

2. Background of the Prior Art

High intensity discharge (HID) lamps are used in many applications because of their long life and high efficiency for converting electrical energy to light. The principal types of HID lamps are mercury vapor, metal halide and high pressure sodium (HPS).

Mercury vapour, metal halide and HPS lamps all operate similarly during stabilized lamp operation. The visible light output results from the ionization of gases confined within an envelope, which gases must be broken down before there is any flow of ionization current. For this reason, a high open circuit voltage must be applied to a HID lamp for ignition purposes and this voltage is substantially higher than the operating voltage and the available line voltage.

Another characteristic of HID lamps is that they exhibit negative resistance; that is, when operating, their resistance decreases with increases on the applied voltage. As a result, such devices require an impedance means in their power supply circuit for limiting the current flow to a predetermined value.

Because of the high starting or igniting voltage requirement and the negative resistance characteristic, HID lamps are provided with igniting and operating circuits which provide a relatively high open circuit voltage and impedance means for current limitation. A ballast between the power supply and the lamp typically serves as the impedance means in igniting and operating circuits for HID lamps. For some HID lamps, such as mercury vapor lamps, igniting voltages are on the order of two times the operating voltage. The igniting voltage is generated by the ballast acting in conjunction with a capacitor. For other types of HID lamps, such as HPS lamps, wherein the required igniting voltages are typically more than ten times the operating voltages, more complex igniting mechanisms or "ignitors" are required. Examples of starting or igniting circuits for such lamps are disclosed in U.S. Pat. No. 4,322,660, to Johnson and U.S. patent application Ser. No. 912,037, recently allowed, to Hitchock. The Johnson patent discloses an apparatus for providing high voltage pulses for starting a HPS discharge lamp, the apparatus having a single capacitor in series with a blocking diode and a charging resistor. When the voltage of the capacitor reaches a predetermined voltage exceeding the zener voltage of a parallel zener diode, the capacitor discharges through a ballast which is connected in autotransformer relationship therewith to provide the high voltage pulse to start the lamp. Hitchcock discloses an apparatus including two capacitors, two blocking diodes, a voltage sensitive symmetrical switch, and multiple resistances across which pulses are distributed. The aforementioned elements are electrically connected together and with a tapped ballast reactor so that one of the capacitors charges through an impedance in the negative half-cycle, and thereafter, when line voltage goes positive the other capacitor charges through an impedance equal to the sum of the multiple resistances. When the voltage of the capacitors reaches a predetermined voltage exceeding the breakdown voltage of the voltage sensitive symmetrical switch, the capacitors discharge. This discharge, because of an autotransformer relationship within the reactor, produces a high voltage pulse of predetermined height and width once per each cycle of the source voltage.

Notwithstanding the many similarities noted above between the various types of HID lamps, there are, however, unique requirements for HPS lamps which the ballast system typically provides. As discussed in the preceding paragraph, some type of electronic ignitor is used in conjunction with the HPS ballast coils to produce a high voltage pulse to start the HPS lamp. In all cases, these electronic ignitors work on the principle of sensing whether or not the HPS lamp is burning, and if not, the ignitor continuously supplies starting pulses to the HPS lamp. Electronic ignitors are generally insensitive to reasons why the HPS lamp is not burning, and, accordingly, function in the same manner regardless of whether the non-burning of a HPS lamp is caused by lamp failure, by absence of a lamp in the lamp socket, or by the lamp "cycling" off. HPS lamp cycling is a well known phenomenon in which a HPS lamp nearing the end of its life will light, burn for some time, go out, relight and repeat this cycle time after time, until the HPS lamp is either replaced or will fail to start at all. The "cycling" phenomenon is due to the characteristic life trend of the lamp operating voltage in a HID lamp. As previously discussed, an HID lamp contains a gas which is confined within an envelope. This results in a high internal gas pressure. Over time some gas will escape from the envelope with a resulting decrease in internal gas pressure. The escape of gas phenomena manifests itself electrically as a significant rise in the HID lamp operating voltage. For example a HID lamp with a nominal lamp operating voltage of 55V may have an operating voltage of approximately 90V towards the end of its life. As a HID lamp nears the end of its life, its lamp operating voltage gets so high that the ballast will no longer sustain operation. In a HPS lamp this condition usually manifests itself as an above-described "cycling" lamp. Further information about this phenomenon is set forth in an article entitled "Recommendations for Lamp Maintenance in High Pressure Sodium Luminaires" in Main-Lighter—Official Publication of the INTERNATIONAL ASSOCIATION OF LIGHTING MAINTENANCE CONTRACTORS, Volume 10, Number 7, page 1 (December 1982).

Means for disengaging ignition circuits for low pressure discharge lamps are known. U.S. Pat. No. 4,438,372 to Zuchtriegel discloses a low pressure discharge lamp operating circuit for connection to a plurality of low pressure discharge lamps. The primary purpose of the operating circuit disclosed in the Zuchtriegel patent is to raise the operating frequencies of the low pressure discharge lamps to a level substantially higher than the frequency of the power network. The operating circuit disclosed may also include a so-called "protective" circuit, to protect the components which make up the primary portion of the operating circuit, from the damaging effects of high voltage feedback. In the absence of the protective circuit the high voltage present across the terminal connections of a lamp under conditions where the lamp is removed, burned out, or otherwise does not fire; would be fed back through the main circuit components, causing substantial heat losses and possible destruction of those components. The protective circuit includes a controlled switching element which shuts off a controlling transistor during excess voltage operation.

The protective circuit disclosed in Zuchtriegel is not appropriate for use in association with HID lamps. As discussed, the operating voltage of a HID lamp increases significantly over time until the ballast is no longer capable of sustaining operation of the lamp and in the case of HPS lamps "cycling" occurs. Low pressure discharge lamps do not display as marked a rise in lamp operating voltages as do HID lamps, therefore the Zuchtriegel protective circuit is not adapted to be used with HID lamps. The protective circuit disclosed in Zuchtriegel will detect a high circuit voltage across the lamp terminals but is insensitive to smaller variations in lamp operations voltage and is simply designed to function in an "on-off" manner, depending upon the presence or absence of lamp ignition. Furthermore, HID lamps are generally used out of doors and therefore any associated disabling circuit must be designed to function over a wide temperature range.

From the foregoing, it should be clear that there are a number of shortcomings in the prior art. In certain cases, e.g. when a HPS lamp is cycling, failed or missing, the ignitor in the lamp's HID circuit continues to operate. Such futile operation shortens ignitor life, particularly in cases where the ignitor operates in conjunction with the ballast so that more than normal excitation power is drawn by the ballast transformer; that is, to be more specific, where the ballast coil is stressed as a consequence of the ignitor operation. Cycling HPS lamps can also cause problems by possibly avoiding easy detection of impending failure. A HPS lamp may be "cycling on" when inspected and, hence, escape replacement. In situations where obtaining access to lamps is difficult and inspections are not frequent, such as when the lamps are used for roadway lighting, failure to detect a cycling lamp will inevitably lead to futile ignitor operation and consequent deterioration.

SUMMARY OF THE INVENTION

To overcome the above-described shortcomings in the prior art, and to provide other advantages and new features described in greater detail below, the present invention, either incorporated into or designed for retrofit into an igniting and operating circuit for a lamp, wherein the lamp has a characteristic voltage which may vary significantly during phases of lamp operation, includes means for disabling the ignition circuit, or where the ignition circuit contains an ignitor portion means for disabling the ignitor after passage of a predetermined amount of time. There are means for establishing a threshold voltage, such threshold voltage being higher than the characteristic voltage of the lamp under normal operating conditions. The means for triggering the disabler has a timing component for measuring the predetermined amount of time, which timing component begins time measuring operation only under certain predetermined conditions; and means for resetting the timing component of the disabler triggering means upon lamp ignition.

Accordingly, one object of the present invention is to disable ignitors for HPS lamps under fault or "no lamp" conditions. Another object of the present invention is to increase the effective lives of ignitors and ballasts in HPS lamp igniting and operating circuits by preventing lamp cycling and unnecessary starter operation that can foster high voltage insulation breakdown. Yet another object of the present invention is to give the lamp user a clear indication of the end of lamp life. A further object of the present invention is to provide an ignitor disabler unit that can be retrofitted to any existing installation at minimum cost, since the ballast does not have to be changed to accommodate the function. Still another object of the present invention is to provide a unit that is substantially independent of the ballast and can therefore be used in conjunction with a wide range of ballasts. The adoption of a power supply portion, in use to convert alternating current to direct current, designed to provide stable output DC voltages over a broad range of input signals, enables the ignitor disabler to be used with "rapid restrike" systems i.e. those systems in which a high power ignitor is used to ensure that a lamp is restruck while it is still hot. A still further object of the present invention is to disable ignition circuits for HID lamps under fault or "no lamp" conditions.

Other objects, advantages, and new features of the invention will become apparent from the following detailed description of the invention when considered in conjunction with the accompanying drawings wherein.

DETAILED DESCRIPTION OF THE INVENTION

Figure 1:
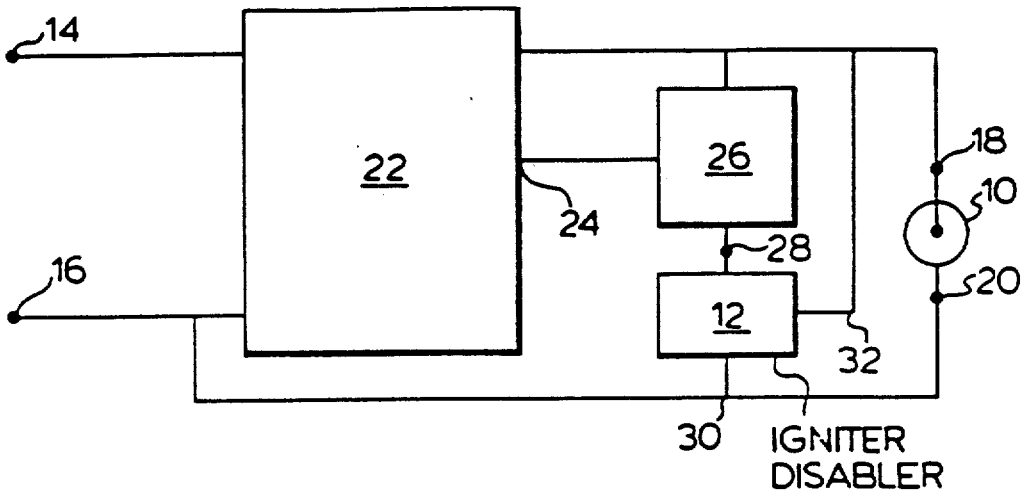
FIG. 1 is a block diagram of an igniting and operating circuit for a HPS lamp, the circuit including therein an ignitor disabler according to the present invention.

In FIG. 1 is shown a schematic diagram of a circuit for connection across an AC source for igniting and operating a HPS lamp 10. The circuit includes an ignitor disabler 12 according to the present invention. The circuit comprises input terminals 14, 16 operable to be connected across the AC source, and output terminals 18, 20 having the lamp 10 connected there, across.

A conventional ballast reactor 22 has a tap 24 intermediate the ends thereof which defines the junction of first and second winding portions, the first winding portion generally having a greater length than the second winding portion, and having a transformation ratio therebetween substantially greater than unity. The ballast reactor 22 is connected at its ends between input terminal 14 and output terminal 18, with the second winding portion connected to the output terminal 18. Input terminal 16 electrically connects the output terminal 20. Details regarding this type of structure and its function are very well known to those skilled in the art and are discussed at length in numerous references, including U.S. Pat. No. 4,107,579 to Bodine. Likewise those skilled in the art recognize the desirability in many cases of including a power correction capacitor (not shown) in HPS lamp circuits. As details regarding inclusion and placement of such a capacitor are well known, they are not discussed further herein.

A conventional ignitor, such as described in the prior art section above, is connected across a second winding portion of ballast 22 so as to exploit the inherent autotransformer relationship therein and thus be capable of generating a high voltage pulse to ignite lamp 10. As can be seen in FIG. 1, this connection across the second winding portion of ballast 22 is accomplished by electrically connecting ignitor 26 at some point within its system to tap 24 and at some other point within its system to output terminal 18. Whereas in conventional igniting and operating circuits for HPS lamps, and note is made here of the teachings in U.S. patent application Ser. No. 912,037, recently allowed, the igniting apparatus also is directly in circuit with output terminal 20, in the circuit shown in FIG. 1 a new element 12, the ignitor disabler according to the present invention, is inserted between ignitor 26 and output terminal 20. As is further shown in FIG. 1, at some point the ignitor disabler system according to the present invention also connects to output terminal 18.

For clarity and convenience, at this point terminal connections to what can be considered an independent ignitor disabler system or retrofittable unit, are designated ignitor disabler terminals 28, 30, 32. Referring to FIG. 1, terminal 28 can be seen to electrically connect to some point within the ignitor 26 system, terminal 30 can be seen to electrically connect to output terminal 20, and terminal 32 can be seen to electrically connect to output terminal 18.

Figure 2:
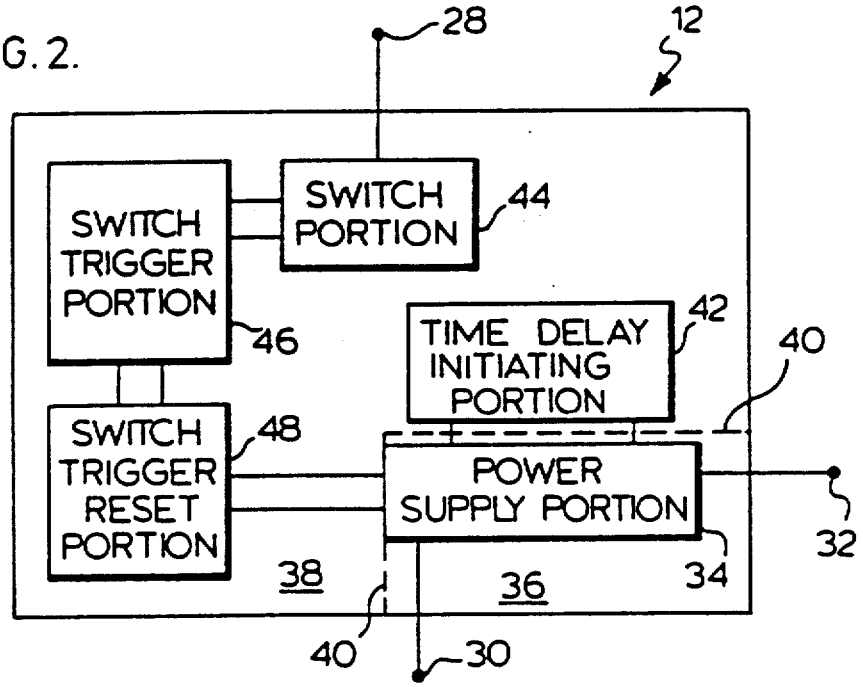
FIG. 2 is a block diagram showing sub-portions of an ignitor disabler according to the present invention.

Referring now to FIG. 2, the ignitor disabler 12 is shown therein in greater detail. Major subcomponents of the disabler 12 are depicted by individual blocks. Terminals 30 and 32 can be seen to electrically connect to a power supply portion 34. Power supply portion 34 is designed to convert alternating current from the ballast secondary winding to direct current. Accordingly, power supply portion 34 effectively divides disabler 12 into an AC part 36 and a DC part 38, the border between the respective parts being designated by dashed line 40.

Terminal 28 can be seen to electrically connect to a switch portion 44. Switch portion 44 is designed to generate an ignitor disabling signal for transmission to ignitor disabler 12 via terminal 28 under certain predetermined conditions. Switch portion 44 is connected to and triggered by a switch trigger portion 46. Under certain predetermined conditions, portion 46 is designed to trigger portion 44, thereby transmitting an ignitor disabling signal out of the disabler via terminal 28. Under the teaching of the present invention, the certain predetermined conditions involve passage of a certain predetermined amount of time. Accordingly, switch trigger portion 46 includes a timing component for measuring time.

Switch trigger portion 46, already discussed as being connected to switch portion 44, is also connected to a switch trigger reset portion 48. Switch trigger reset portion 48 is designed to sense through various connections which ultimately lead to terminals 30 and 32, across which lamp 10 is connected, lamp 10 ignition. Once switch trigger reset portion 48 senses lamp 10 ignition, it resets trigger portion 46 by, under the teaching of the present invention, stopping and immediately resetting to zero the timing component within the switch trigger reset portion.

The time delay initiating portion 42, is designed, in part, to perform the opposite function of switch trigger reset portion 48. Whereas switch trigger reset portion 48 stops and immediately resets switch trigger portion 46, time delay initiating portion 42 sets the timing component into operation. Once the timing component is set into operation, by means discussed immediately below, unless the reset portion subsequent senses lamp ignition and terminates time measurement, switch trigger portion 46 will trigger switch portion 44 and cause transmission of an ignitor disabling signal out of disabler 12. An important aspect of portion 42 under the teaching of the present invention should be noted. Portion 42 includes means for establishing a threshold voltage. As discussed in the description of a preferred embodiment below, this threshold voltage can be used as a bench mark for establishment of the certain predetermined conditions which begin the measuring of time within the switch trigger portion 46. For example, as in the preferred embodiment described below, this threshold voltage could be compared to the operating voltage of a lamp 10 and systematically connected so as to begin the time measuring if and when the lamp operating voltage exceeds the threshold voltage. It should be remembered, as discussed in the background of the prior art section above, that a HID lamp's, and in this specific example a HPS lamp's operating voltage rises significantly over the course of its life, so that occurrence of an operating voltage becoming greater than a threshold voltage is an effective timing trigger.

Figure 3:
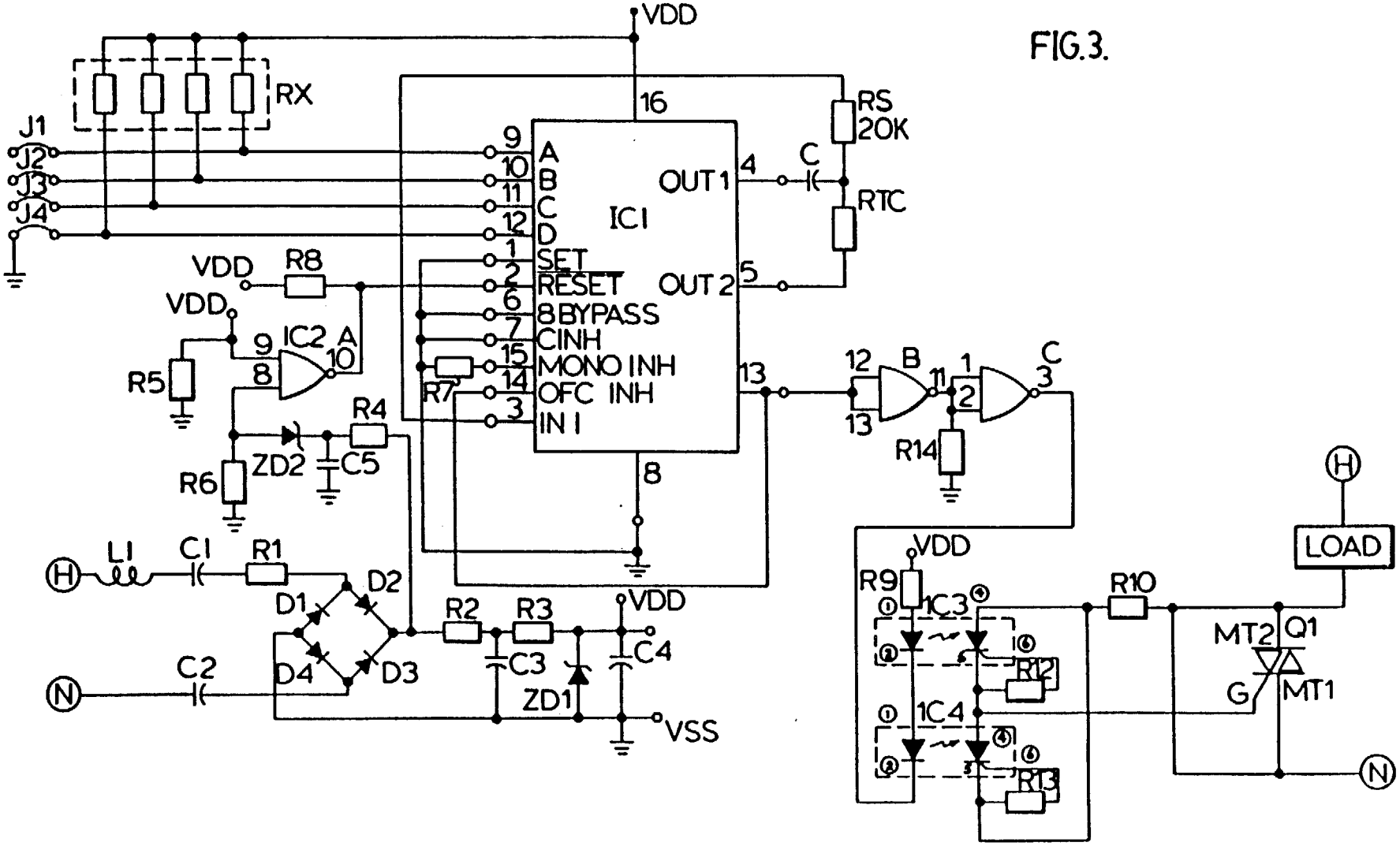
FIG. 3 is a circuit diagram of a preferred embodiment of an ignitor disabler according to the present invention.

Referring now to FIG. 3, shown therein is a circuit diagram for a preferred embodiment of the ignitor disabler of the present invention. The particulars of this illustrative embodiment are especially suitable for use with conventional HPS lamps up to 150 watts, maximum. The topography is basically the same as in FIG. 2 except for including some circuit details for practical application. Terminals 32, 30, 28 correspond to the identically numbered terminals in FIGS. 1 and 2.

The power supply portion 34 of the circuit of FIG. 3 comprises inductor L-1, capacitors C-1, C-2, C-3 and C-4, resistors R-1, R-2, R-3, diodes D-1, D-2, D-3, D-4 and zener diode ZD-1. Of course, it should be readily apparent to those skilled in the art that alternating current applied across terminals 32, 30 will be converted to direct current by operation of diodes D-1, D-2, D-3, D-4.

The time delay initiating portion 42 which as mentioned above, performs a threshold-establishing function, comprises resistors R-4, R-5, R-6 and R-8 zener diode ZD-2, capacitor C-5 and NAND-type gate IC-2.

The switch trigger reset portion 48 comprises the same circuit elements as the time delay initiating portion.

The switch-trigger portion 46 comprises resistors R-7, R-9, R-10, R-12, R-13, R-14, R-TC, R-S and R-X, capacitor C and integrated circuits IC-3 and IC-4, and NAND-type gates B and C. Those skilled in the art will appreciate that the switch-trigger portion includes an opto-isolator circuit which operates to apply a trigger pulse to the gate of triac Q-1. A voltage corresponding to a logic 0 when applied to the reset pin number 2 of chip IC-1 will cause an output voltage at output pin 13 corresponding to a logic 1 after a pre-determined time defined in part by the values of capacitor C and resistor R-TC. That voltage at pin 13 will cause the optoisolator circuit to be turned off.

The switch portion 44 of disabler 12 comprises a bi-directional triode thyristor or triac Q-1 which is inserted between terminal 28 and switch-trigger portion 46. Triac Q1 controls the AC power to the ignitor 26. Triac Q1 exercises such control because it is in series with the common and ignitor connection point 28 as depicted in FIG. 1.

By the way of example only, a circuit such as shown in FIG. 3 could be constructed of components having designations or values as listed below.

| Element Number | Type of Element | Designation or Value |
|---|---|---|
| D1-D4 | diode | IN4004 |
| IC1 | programmable timer | MC14536 BAL |
| IC2, B, C | NAND gate | MC14093 BAL |
| IC3, IC4 | opto coupler | MC3003/4N40 |
| $C_1$, $C_2$ | capacitors | 1.0 μF |
| $C_3$ | capacitor | 0.1 μF |
| $C_4$ | capacitor | 470 μF |
| $C_5$ | capacitor | 33 μF |
| C | capacitor | 0.1 μF |
| $R_i$ | resistor | 560 Ω |
| $R_2$ | resistor | 510 Ω |
| $R_3$ | resistor | 33 Ω |
| $R_4$ | resistor | 5.6 K Ω |
| $R_5$ | resistor | 100 K Ω |
| $R_6$ | resistor | 100 K Ω |
| $R_7$ | resistor | 10 K Ω |
| $R_8$ | resistor | 100 K Ω |
| $R_9$ | resistor | 510 Ω |
| $R_{10}$ | resistor | 180 Ω |
| $R_{12}$, $R_{13}$ | resistors | 47 K Ω |
| $R_{14}$ | resistor | 100 K Ω |
| $R_{TC}$ | resistor | 10 K Ω |
| $R_s$ | resistor | 22 K Ω |
| $R_x$ | resistor | 47 K Ω |
| $ZD_1$, | zener diode | 1N4743 |
| $ZD_2$ | zener diode | 1N4742 |
| $Q_1$ | triac | 2N6071 |
| $L_1$ | inductor | 50 mH |

In the preferred embodiments of the present invention, of which the embodiment of FIG. 3 is but an example, the built-in time delay will be sufficient to accommodate momentary interruptions of power resulting in lamp outage. As is well known to those skilled in the art, lamp and fixture combinations, after operating for some time and being reignited, must cool down to a certain degree before the lamp is capable of being reignited. In such "hot restrike" circumstances, if the operation of the ignitor disabler is not withheld and if a sufficient time is not allowed for the ignitor to remain in the "on" mode, past the cool-down period, the high voltage restrike pulses will cease before the lamp is capable of reignition, resulting in lack of lamp restrike. The various elements of the circuit depicted in FIG. 3 are of such value and are so operatively connected as to provide sufficient time for hot restrike of lamps to take place.

From the foregoing description and identification of circuit components, those skilled in the art will readily appreciate and understand the operation of the present example of the invention. Lamp 10 voltage passes through inductor L-1 which filters the high voltage starting pulses from the 120 V AC present at that point. Capacitors C-1 and C-2 are AC impedances and perform a voltage dropping and current limiting function for the positive 13 V DC supply. Resistor R-1 also performs a similar voltage dropping function. Diodes D-1, D-2, D-3 and D-4 comprise a full-wave rectifier with the result that a substantially direct type voltage signal, variable with the input lamp voltage is provided at the inputs of resistors R-2 and R-4. Resistor R-2 and capacitor C-3 comprise a filter which tends to smooth out the variable signal while resistor R-3 and zener diode ZD-1 comprise a voltage regulator which has the effect of further stabilizing the input signal and clamping it at approximately 13 V DC. Capacitor C-4 performs a final smoothing function thereby providing a stable DC voltage of approximately 13 V DC for use throughout the circuit and designated as VDD in FIG. 3.

The substantially direct voltage signal, which is variable with the lamp voltage is also provided to the input of resistor R-4. Resistor R-4 and capacitor C-5 comprise a filter which performs a smoothing function so that the input voltage to zener diode ZD-2 more closely resembles a pure DC voltage. The circuit parameters are chosen so that under normal operating lamp conditions the voltage at the input of zener diode ZD-2 is below the characteristic break down voltage of the diode. As those skilled in the art will readily recognize, this results in an output voltage at pin 10 of NAND-type gate IC-2 corresponding to a logic 1. Should the voltage at the input of ZD-2 exceed the characteristic breakdown voltage of the diode, an output voltage corresponding to a logic 0 will appear at pin 10 of NAND-type gate IC-2.

The operation of oscillator chip IC-1 is well-known to those skilled in the art. A voltage corresponding to a logic 0 when applied to reset pin 2 will cause an output voltage corresponding to a logic 1 at pin 13 after a duration of time defined firstly, by the values of capacitor C and resistor R-TC which governs the frequency of a single oscillation and secondly, by the values of the voltages at input pins 9, 10, 11 and 12, which collectively govern the number of oscillations. The remainder of the switch-trigger portion of the circuit is comprised of two NAND-type gates in series which provide a simple buffer function together with the opto-isolator circuit made up of integrated circuits IC-3, IC-4, resistors R-9, R-10, R-12, R-13.

At this point, practical operation of the ignitor disabler should be readily apparent to those skilled in the art. For example, when incorporated into or retro fitted into an igniting and operating circuit for an HPS lamp and the lamp cold start is undertaken, the ignitor disabler will have no effect and the lamp will start and operate normally. Under a cold start (unlamped) condition with the ignitor disabler in the circuit, the high voltage pulses will cease after the predetermined interval. If the lamp is inserted into a receptacle of a fixture under these conditions, the lamp will not ignite and it will be necessary to reset the disabler. Resetting under these conditions would entail turning the power off and on again which will lead to the lamp igniting and functioning normally. If a short power interruption were to occur, the circuit having the disabler will extinguish the lamp, and a cool-down period of 30 to 60 seconds will occur before the lamp is reignited. This is identical to operation of circuits without a disabler installed, as the disabler resets itself automatically. If the lamp is faulty or if the lamp's parameters go beyond the capability of the ballast output, as in the case of a cycling "end-of-life" HPS lamp, the disabler will disable the ignitor and, hence, increase its useful life. In a prior art regular system, on the other hand, the ignitor would have continued to supply high voltage, and so reduce the ignitor's operational life. It may be noted that, in the case of the cycling "end-of-life" HPS lamp, switching the power off and on again resets the disabler and the lamp will be reignited and run for a cycle.

With regard to a method of application of a circuit according to the present invention, a printed circuit board containing the circuitry as shown in FIG. 3 and potted in a can approximately 2¼"×1½"×2¼" oval, with three leads protruding outside the can for connecting purposes can be constructed by conventional techniques. Further, the can can be insulated by polyolefin heat-shrinked tube to prevent shorting to surrounding circuitry, also a conventional technique. An alternative construction would be to cast the circuit board in a potting compound without a separate metal can.

A unique aspect of the ignitor disabler of the present invention is its independence from the ballast. Because of this independence, the disabler can be used in conjunction with any standard ballast/ignitor currently commercially available, with appropriate adjustment of element values within the disabler in accordance with the system requirements. The preferred embodiment to FIG. 3 can itself be used on any primary voltage from 120 volts to 600 volts without modification since it derives its power from the ballasts' secondary winding which in all cases involving lamps of 150 watts or lower provides the 120 volt open circuit voltage dictated by the arc tube voltage requirements of such lamps. Further, in all potential embodiments of the disabler of the present invention, because each is a separate unit, each can be retrofitted to any existing installation at minimal costs, since the ballast does not have to be changed to accommodate the disabler function.

The time delay characteristics of the circuit can be easily modified by changing the inputs to pins 9, 10, 11, and 12 of the oscillator chip IC-1. The circuit can therefore be adapted to operate with a variety of different time delays with the same circuit components, unlike the previous analog versions of ignitor disablers.

Obvious, numerous modifications and variations of the present invention are possible in light of the above teachings. For example, components in the presently preferred embodiment could be changed to allow the circuit to operate satisfactorily for 100-volt ballast-/lamp combinations, suitable for 150-watt, 250-watt and 400-watt H.P.S. lamps, as follows:

| Element Number | Type of Element | Designation or Value |
|---|---|---|
| D-D4 | diode | IN4004 |
| D-D4 | diode | IN4004 |
| IC1 | programmable timer | MC14536 BAL |
| IC2, B, C | NAND gate | MC14093 BAL |
| IC3, IC4 | opto coupler | MC3003/4N40 |
| $C_1$, $C_2$ | capacitors | .56 μF |
| $C_3$ | capacitor | 0.1 μF |
| $C_4$ | capacitor | 470 μF |
| $C_5$ | capacitor | 33 μF |
| $C_6$ | capacitor | 0.1 μF |
| C | capacitor | 0.1 μF |
| $R_i$ | resistor | 560 Ω |
| $R_2$ | resistor | 510 Ω |
| $R_3$ | resistor | 33 Ω |
| $R_4$ | resistor | 5.6 K Ω |
| $R_5$ | resistor | 100 K Ω |
| $R_6$ | resistor | 100 K Ω |
| $R_7$ | resistor | 10 K Ω |
| $R_8$ | resistor | 100 K Ω |
| $R_9$ | resistor | 510 Ω |
| $R_{10}$ | resistor | 180 Ω |
| $R_{11}$ | resistor | 2.4 K Ω |
| $R_{12}$, $R_{13}$ | resistors | 47 K Ω |
| $R_{14}$ | resistor | 100 K Ω |
| $R_{TC}$ | resistor | 10 K Ω |
| $R_s$ | resistor | 22 K Ω |
| $R_x$ | resistor | 47 K Ω |
| $ZD_1$, | zener diode | 1N4743 |
| $ZD_1$ | zener diode | 1N4742 |
| $Q_1$ | triac | 2N6071 |

-continued

| Element Number | Type of Element | Designation or Value |
|---|---|---|
| $L_1$ | inductor | 50 mH |

Figure 4:
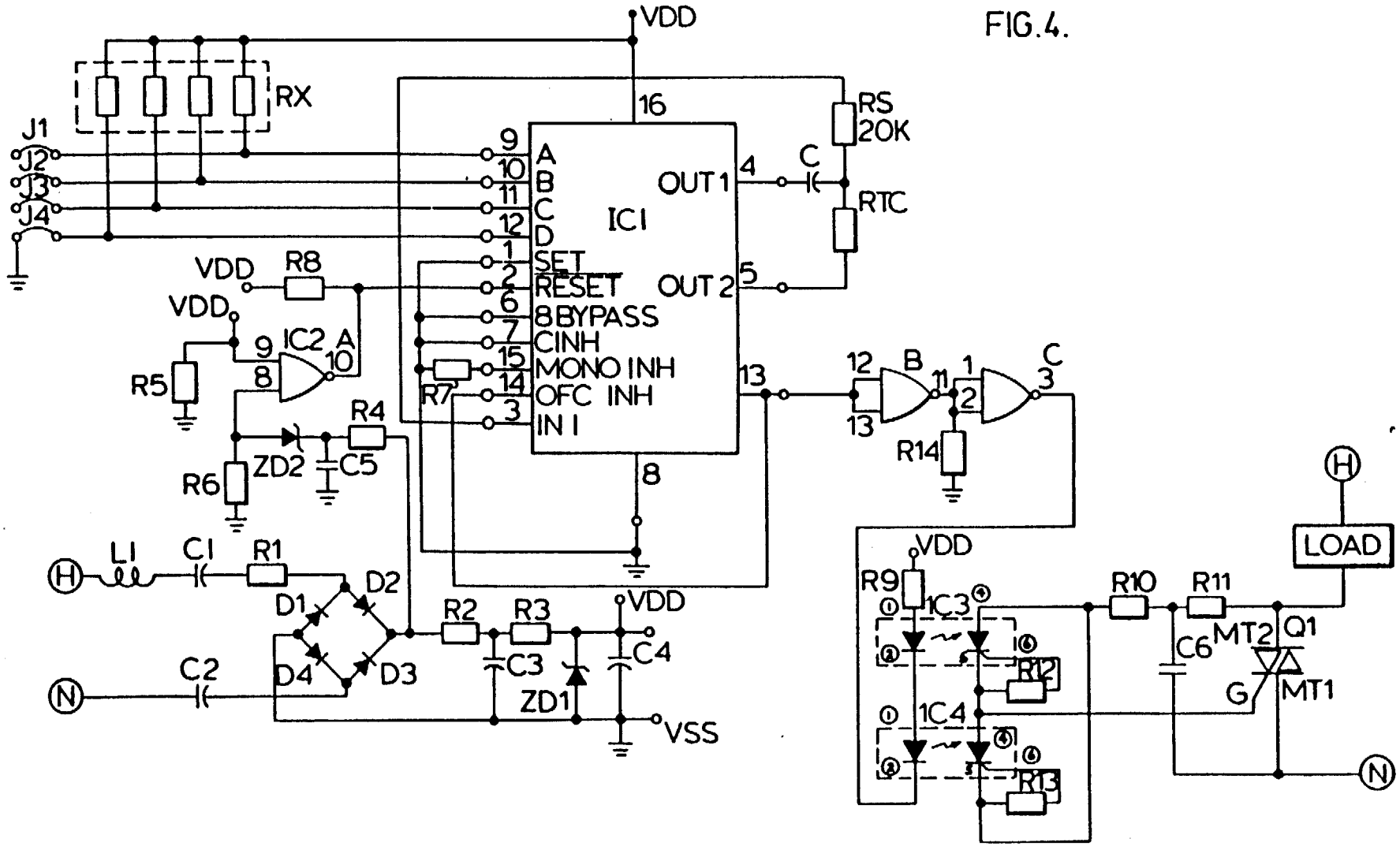
FIG. 4 is a circuit diagram of another embodiment of an ignitor disabler according to the present invention.

Referring now to FIG. 4, shown therein is a circuit diagram for a preferred embodiment of the ignitor disabler of the present invention especially suitable for use with conventional HPS lamps from 150 to 400 watts maximum.

Similarly other nominal lamp operating voltages can be accommodated by changing the value of the above components.

Although the examples of the invention discussed above relate to an ignitor disabler for use in a HPS lamp ignition circuit which includes an ignitor portion, the present invention may be practiced with other HID lamps such as mercury vapor and metal halide lamps. Although mercury vapor and metal halide lamps do not utilize ignition circuits with ignitor portions, it should be remembered as discussed in the background of the prior art section above, their operating voltages, like the operating voltages of HPS lamps, increase significantly over time. The present invention can be used to disable a portion of the ignition circuit of a mercury vapor or metal halide lamp other than an ignitor portion, and can therefore be practised with non-HPS type HID lamps.

It is therefore to be understood that, within the scope of the independent claims, the present invention may be practised otherwise than as specifically described here and above.

What is claimed is:

1. An ignitor disabler for use with a circuit for igniting a lamp, including an ignitor portion, wherein the lamp has a characteristic voltage which may vary during phases of lamp operation and wherein the lamp has a nominal operating voltage between 52 volts and 100 volts, comprising:

(a) a bi-directional triode thyristor or triac which is connected in series with the common line and the ignitor connection point in such a manner that when the triac is turned off it prevents the ignitor from functioning;

(b) a circuit connected between a power supply portion and the reset pin of an oscillator chip, the circuit including a zener diode biased such that its breakdown voltage exceeds the voltage at the input of the circuit under normal lamp operating conditions, the circuit being designed to generate an output voltage corresponding to a logic 0 upon sensing conduction by the zenner diode;

(c) trigger means comprising:

(i) an oscillator chip with pin connections and associated circuit components such that an input voltage corresponding to a logic 0 at the reset pin of the oscillator chip causes an output voltage corresponding to a logic 1 to appear at the output pin of the oscillator chip after a predetermined period of time;

(ii) a buffer stage with input connected to the output pin of the oscillator chip; and (iii) an opto-isolator circuit with input connected to the output of the buffer stage in such a manner that a logic 1 voltage generated at the output of the buffer stage when fed to the emitter side of the opto-isolator results in the opto-isolator circuit being turned off thereby engaging the disabling means.

(d) A circuit with output connected to the reset pin of the oscillator chip, the circuit being designed to generate an output voltage corresponding to a logic 1 upon sensing lamp ignition being accomplished;

(e) A power supply portion comprising:

(i) a first stage series resonant circuit connected across the lamp terminals designed to attenuate the high frequency harmonics generated by the high voltage starting pulses, from the lamp voltage and to reduce the voltage;

(ii) a second stage full-wave rectifier to receive the output from the first stage designed to generate a substantially direct current type, the voltage equivalent of which is dependent upon the lamp operating voltage, this substantially direct voltage signal forming the input signal for both the threshold establishing circuit and a third stage of the power supply;

(iii) a filtering third stage to receive the output from the second stage and designed to generate a signal which more closely approximates a direct current type signal;

(iv) a voltage regulating fourth stage to receive the output signal from the third stage and to generate a signal which more closely approximates a direct voltage-type signal;

(v) a filtering fifth stage to receive the output signal from the fourth stage and to generate a final signal in which substantially all of the alternating type components have been attenuated.

2. The invention as defined in claim 1 wherein the lamp is a high pressure sodium (HPS) lamp.

3. An ignitor disabler for use with a circuit for igniting a lamp, including an ignitor portion wherein the lamp has a characteristic voltage which may vary significantly during phases of lamp operation; said ignitor disabler comprising:

(a) disabling means for the ignitor, the disabling means comprising a bi-directional triode thyristor (triac) which is connected in series with the common line and the ignitor connection point in such a manner that when the triac is turned off it prevents the ignitor from functioning;

means for receiving AC power, and a power supply portion, in use to convert alternating current to direct current and which respectively constitute an AC part and a DC part of said disabler;

(b) means for establishing a threshold voltage; which threshold voltage is higher than the characteristic voltage of the lamp under normal operating conditions;

(c) triggering means for triggering the disabling means after the passage of a predetermined amount of time, the triggering means having a timing component for measuring the predetermined amount of time, which timing component begins time measuring operation only under certain predetermined conditions including all conditions in which the characteristic voltage of the lamp exceeds the threshold voltage;

(d) reset means for resetting the timing component of the triggering means upon lamp ignition;

wherein the triggering means comprises;

(i) an oscillator chip with pin connections and associated circuit components such that an input voltage corresponding to a logic 0 at the reset pin of the oscillator chip causes an output voltage corresponding to a logic 1 to appear at the output pin of the oscillator chip after a predetermined period of time;

(ii) a buffer stage with input connected to the output pin of the oscillator chip; and (iii) an opto-isolator circuit with input connected to the output of the buffer stage in such a manner that a logic 1 voltage generated at the output of the buffer stage when fed to the emitter side of the opto-isolator results in the opto-isolator circuit being turned off thereby turning off the triac.

4. The invention as defined in claim 3 wherein the reset means is a circuit with output connected to the reset pin of the oscillator chip, the circuit being designed to generate an output voltage corresponding to a logic 1 upon sensing lamp ignition being accomplished.

5. The invention as defined in claim 4 wherein the means for establishing a threshold voltage is a circuit connected between the power supply portion and the reset pin of the oscillator chip, the circuit including a zener diode biased such that its breakdown voltage exceeds the voltage at the input of the circuit under normal lamp operating conditions, the circuit being designed to generate an output voltage corresponding to a logic 0 upon sensing conduction by the zener diode.

6. The invention as defined in claim 5 wherein the power supply portion comprises:

(a) first stage series resonant circuit connected across the lamp terminals designed to attenuate the high frequency harmonics generated by the high voltage starting pulses, from the lamp voltage and to reduce the voltage;

(b) a second stage full-wave rectifier to receive the output from the first stage designed to generate a substantially direct current type, the voltage equivalent of which is dependent upon the lamp operating voltage, this substantially direct voltage signal forming the input signal for both the threshold establishing circuit and a third stage of the power supply;

(c) a filtering third stage to receive the output from the second stage and designed to generate a signal which more closely approximates a direct current type signal;

(d) a voltage regulating fourth stage to receive the output signal from the third stage and to generate a signal which more closely approximates a direct voltage-type signal;

(e) a filtering fifth stage to receive the output signal from the fourth stage and to generate a final signal in which substantially all of the alternating type components have been attenuated.

7. A disabler for use with a circuit for igniting a lamp, wherein the lamp has a characteristic voltage which may vary significantly during phases of lamp operation; said disabler comprising:

(a) disabling means for the circuit comprising means for receiving AC power, and a power supply portion, in use to convert alternating current to direct current and which respectively constitute an AC part an da DC part of said disabler;

(b) means for establishing a threshold voltage; which threshold voltage is higher than the characteristic voltage of the lamp under normal operating conditions;

(c) triggering means for triggering the disabling means after the passage of a predetermined amount of time, the triggering means having a timing component for measuring the predetermined amount of time, which timing component begins time measuring operation only under certain predetermined conditions including all conditions in which the characteristic voltage of the lamp exceeds the threshold voltage;

(d) reset means for resetting the timing component of the triggering means upon lamp ignition;

wherein the triggering means comprises;

(i) an oscillator chip with pin connections and associated circuit components such that an input voltage corresponding to a logic 0 at the reset pin of the oscillator chip causes an output voltage corresponding to a logic 1 to appear at the output pin of the oscillator chip after a predetermined period of time;

(ii) a buffer stage with input connected to the output pin of the oscillator chip; and (iii) an opto-isolator circuit with input connected to the output of the buffer stage in such a manner that a logic 1 voltage generated at the output of the buffer stage when fed to the emitter side of the opto-isolator results in the opto-isolator circuit being turned off thereby engaging the disabler means.

8. The invention in claim 7 wherein the trigger means comprises:

(a) an oscillator chip with pin connections and associated circuit components such that an input voltage corresponding to a logic 0 at the reset pin of the oscillator chip causes an output voltage corresponding to a logic 1 to appear at the output pin of the oscillator chip after a predetermined period of time;

(b) a buffer stage with input connected to the output pin of the oscillator chip; and (c) an opto-isolator circuit with input connected to the output of the buffer stage in such a manner that a logic 1 voltage generated at the output of the buffer stage when fed to the emitter side of the opto-isolator results in the opto-isolator circuit being turned off thereby engaging the disabling means.

9. The invention in claim 8 wherein the reset means is a circuit with output connected to the reset pin of the oscillator chip, the circuit being designed to generate an output voltage corresponding to a logic 1 upon sensing lamp ignition being accomplished.

10. The invention as defined in claim 9 wherein the means for establishing a threshold voltage is a circuit connected between the power supply portion and the reset pin of the oscillator chip, the circuit including a zener diode biased such that its breakdown voltage exceeds the voltage at the input of the circuit under normal lamp operating conditions, the circuit being designed to generate an output voltage corresponding to a logic 0 upon sensing conduction by the zener diode.

11. The invention as defined in claim 10 wherein the power supply, portion comprises:

(a) a first stage series resonant circuit connected across the lamp terminals designed to attenuate the high frequency harmonics generated by the high voltage starting pulses, from the lamp voltage and to reduce the voltage;

(b) a second stage full-wave rectifier to receive the output from the first stage designed to generate a substantially direct current type, the voltage equivalent of which is dependent upon the lamp operating voltage, this substantially direct voltage signal forming the input signal for both the threshold establishing circuit and a third stage of the power supply;

(c) a filtering third stage to receive the output from the second stage and designed to generate a signal which more closely approximates a direct current type signal;

(d) a voltage regulating fourth stage to receive the output signal from the third stage and to generate a signal which more closely approximates a direct voltage-type signal;

(e) a filtering fifth stage to receive the output signal from the fourth stage and to generate a final signal in which substantially all of the alternating type components have been attenuated.

* * * * *